US005542951A

United States Patent [19]

Antwerpen et al.

[11] Patent Number: 5,542,951

[45] Date of Patent: Aug. 6, 1996

[54] USE OF COPOLYMERS BASED ON VINYL MONOMERS AND CARBOXYLIC ACID AMIDES AS A DETERGENT ADDITIVE

[75] Inventors: Werner Antwerpen, Schwalbach; Hermann Schindler, Hofheim; Gerd Reinhardt, Kelkheim, all of Germany

[73] Assignee: Hoechst Aktiengesellschaft, Frankfurt am Main, Germany

[21] Appl. No.: 195,861

[22] Filed: Feb. 10, 1994

[30] Foreign Application Priority Data

Feb. 12, 1993 [DE] Germany ..... 43 04 313.5

[51] Int. Cl.[6] ..... B08B 3/08; C11D 3/32; C11D 3/37; C11D 17/06

[52] U.S. Cl. ..... 8/137; 510/475; 510/476; 510/337; 510/360; 510/513

[58] Field of Search ..... 252/174.23, 174.24, 252/546, 544, 174, DIG. 2, DIG. 3, DIG. 11, DIG. 15; 8/137

[56] References Cited

U.S. PATENT DOCUMENTS

| | | | |
|---|---|---|---|
| 3,870,673 | 3/1975 | Rauterkus et al. | 260/29.6 A |
| 3,950,302 | 4/1976 | Rauterkus et al. | 260/42.52 |
| 4,083,794 | 4/1978 | Lee et al. | 252/DIG. 2 |
| 4,485,209 | 11/1984 | Fan et al. | 524/801 |
| 4,737,386 | 4/1988 | Wotier et al. | 427/389.9 |
| 4,816,558 | 3/1989 | Rauch et al. | 528/501 |
| 4,866,119 | 9/1989 | Mudge | 524/510 |
| 4,975,524 | 12/1990 | Berendt | 528/366 |
| 5,227,446 | 7/1993 | Denzinger et al. | 527/314 |

FOREIGN PATENT DOCUMENTS

| | | |
|---|---|---|
| 2232353 | 1/1973 | Germany . |
| 2905121 | 8/1980 | Germany . |
| 3711299 | 10/1988 | Germany . |

*Primary Examiner*—Douglas J. McGinty
*Attorney, Agent, or Firm*—Connolly and Hutz

[57] ABSTRACT

Use of copolymers based on vinyl monomers and carboxylic acid amides as a detergent additive The present invention relates to the use of copolymers comprising 75–95% by weight of the total amount of the monomer of at least one vinyl monomer which is free from carboxyl and amide groups, 5–20% by weight of at least one carboxylic acid amide of the formula (I)

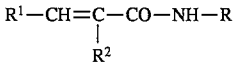

in which

R is a hydrogen atom or a methylol radical, $R^1$ is a hydrogen atom or a $C_1$–$C_3$-alkyl radical and $R^2$ is a hydrogen atom or a methyl radical and if appropriate together with not more than 5% by weight of a copolymerizable unsaturated carboxylic acid, as a detergent additive for preventing the reabsorption of detached dyestuffs and dyestuff degradation products.

14 Claims, No Drawings

USE OF COPOLYMERS BASED ON VINYL MONOMERS AND CARBOXYLIC ACID AMIDES AS A DETERGENT ADDITIVE

DESCRIPTION

A method for preventing reabsorption of detached dyestuffs and dyestuff degradation products.

The laundry to be cleaned nowadays in the home and industry comprises uniform or, especially in the home, mostly different types of fiber, in particular naturally occurring fibers, chiefly cotton or wool, regenerated cellulose fibers, for example viscose, synthetic fibers, for example polyester, polyamide and polyacrylonitrile, and mixtures of such fibers. In contrast to the so-called "white wash", which comprises undyed textiles, the so-called "colored wash" is composed of dyed textiles, usually in various color shades and depths of color, from pale or pastel to dark. It goes without saying that textiles having the most diverse color-fastenesses can be present in one washing operation of domestic colored laundry. If the dyeings are not sufficiently fast to washing here, detachment of dyestuff or dyestuff degradation products and bleeding thereof into the wash liquor occurs during the washing process. Due to reabsorption of these detached (bled) constituents onto the other textiles washed at the same time, the result is "staining": a shift in shade and/or spot formation resulting from the bled, re-absorbed dyestuff or dyestuff degradation products, which may be non-uniformly distributed. The detachment and/or dyestuff decomposition of a dyeing which is not sufficiently fast is promoted, for example, by higher temperatures, repeated washing operations, the liquor ratio of wash liquor to laundry, the composition of the detergent employed and the concentration thereof in the wash liquor, it also being possible for the type of washing machines and wash programs used to have an influence on the detachment of dyestuff or dyestuff degradation products of a dyeing which is not sufficiently "appropriate for domestic washing", for example due to the mechanical stress on the laundry during washing and the like. The water quality used (for example due to the chlorine content), the composition of certain additives for easy-care handling and the quality and structure of the textile material or fibers may be mentioned as further reasons for a drop in fastness. Laundry of cellulose fibers, above all cotton, may be mentioned as an example; this is usually dyed using direct dyestuffs, reactive dyestuffs, sulfur dyestuffs, vat dyestuffs or naphthol dyestuffs, chiefly with direct dyestuffs or reactive dyestuffs. Both dyeings with direct dyestuffs and dyeings with reactive dyestuffs on cellulose tend to "bleed" into the wash liquors to a greater or lesser degree during repeated washing—and the wash liquors consequently contain non-fixed dyestuff, hydrolyzed dyestuff and/or dyestuff which has been split off—which leads to the problems described above.

The color transfer reaction is often divided into two component steps:

detachment of dyestuff particles from the textile fiber redeposition at another site on the laundry.

Various proposals have been described in the literature for prevention of this reaction.

On the one hand, it is possible to destroy the dyestuff by oxidation while it is present in dissolved form in the wash liquor. This presents no problem if conventional heavy-duty detergents are used, since these usually contain a bleaching system comprising perborate and a persalt activator, such as tetraacetylethylenediamine, TAED. The peracetic acid formed therefrom completely destroys the dissolved dyestuffs, before adsorption onto the fiber is possible. A disadvantage here is, however, that color damage due to bleaching out of the textile colors can also occur with reactive perborate activators.

In addition to bleaching activators, enzymes having peroxidase properties are also suitable for these uses (WO-A-91/05839).

Another possibility for preventing color transfer is incorporation of polymeric color transfer inhibitors into the detergent formulation.

Preferred inhibitors which are employed are homopolymers of vinylimidazole and vinylpyrrolidone.

DE-A-22 32 353 describes detergent formulations which have a reduced color transfer during the washing operation and contain polyvinylpyrrolidone (PVP).

DE-A-38 03 630 discloses detergent additives for avoiding color transfer during washing, which comprise polymers based on N-vinylpyrrolidone, N-vinylimidazole or N-vinyloxazolidone.

DE-A-37 11 299 discloses polyvinylpyrrolidones grafted with vinyl esters as graying inhibitors for textiles containing synthetic fibers.

The disadvantage of these polymeric color transfer inhibitors is their often low solubility, in particular in the case of modified polyvinylpyrrolidones, which makes incorporation into liquid detergent formulations difficult, and their inadequate biodegradability.

The as yet unpublished European Patent Application No. 93113207.0 discloses the use of water-soluble copolymers based on acrylamidoalkylenesulfonic acid, vinylacetamide and if appropriate further monomers as a detergent additive for preventing the reabsorption of detached dyestuffs and dyestuff degradation products. However, no polymer dispersions or redispersible dispersion powders, such as are obtained by drying of aqueous polymer dispersions, can be prepared from the copolymers described.

The as yet unpublished European Patent Application No. 93113341.7 mentions the use of partly and/or completely hydrolyzed polyvinyl alcohols as a detergent additive for preventing the reabsorption of dyestuffs and dyestuff products. It has been found that these polymers can undergo undesirable side reactions in the presence of boric acid or boric acid derivatives, including perborates in particular, and are therefore not particularly suitable for use in boron-containing detergents.

It is known from U.S. Pat. No. 3 870 673 to prepare emulsifier-free polymer dispersions by polymerization of vinyl esters, ethylene and an acrylamide in an aqueous medium by means of a redox initiator system.

These polymer dispersions are finely divided and form a more or less clear polymer film after drying. They are suitable, for example, for compaction of non-woven fibers, as binders in emulsion paints and coating compositions for paper, for the preparation of adhesives and sizes, for use in the building materials sector, as a pigment binder for pigment printing and for finishing textiles.

It is furthermore known from U.S. Pat. No. 3 950 302 that powders which give stable dispersions by redispersion in water can be prepared from emulsifier-free polymer dispersions based on vinyl esters/ethylene/acetamide copolymers by drying. The dispersion powders are suitable for the preparation of adhesive coatings which can be remoistened, and can also be used in wallpaper paste compositions and for recoatings on wallpaper, and furthermore as binders in emulsion paints and plasters bound with plastic, and for textile finishing.

DE-C-29 05 121 furthermore discloses a process for the preparation of an aqueous stable polymer dispersion by polymerization of at least one vinyl monomer which is free from carboxyl and amide groups and at least one carboxylic acid amide of the formula (I)

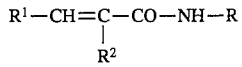

in which R is a hydrogen atom or a methylol radical, $R^1$ is a hydrogen atom or a $C_1$–$C_3$-alkyl radical and $R^2$ is a hydrogen atom or a methyl radical. The polymer dispersions are suitable as binder dispersions in emulsion paints, and preferably as starting materials for the preparation of redispersible films and powders for adhesive purposes. Such redispersible adhesive coatings are used in particular in flat rubber coatings, rolls of adhesive tape, sizes, finishes, carpet adhesives and carriers for washable painter's colors.

It has now been found that copolymers comprising 75–95% by weight of the total amount of monomer of at least one vinyl monomer which is free from carboxyl and amide groups, 5–20% by weight of at least one carboxylic acid amide of the formula (I)

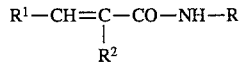

in which R is a hydrogen atom or a methylol radical, $R^1$ is a hydrogen atom or a $C_1$–$C_3$-alkyl radical and $R^2$ is a hydrogen atom or a methyl radical, and if appropriate together with not more than 5% by weight of a copolymerizable, unsaturated carboxylic acid, are suitable as a detergent additive for preventing reabsorption of detached dyestuffs and dyestuff degradation products (color transfer inhibitors).

The invention relates to the use of copolymers as claimed in claim 1 as a detergent additive for preventing the reabsorption of detached dyestuffs and dyestuff degradation products.

The copolymers used according to the invention comprise, as vinyl monomers, a polymerizable compound having an $H_2C{=}CH$-group which is free from carboxyl and amide groups. Particularly suitable compounds are those of the formula (II)

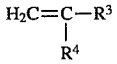

in which $R^3$ is (a) a hydrogen atom or an alkyl radical having 1, 2 or 3 carbon atoms, (b) a homo- or heterocyclic radical having 5 or 6 ring members, (c) an alkoxy radical having 1, 2, 3 or 4 carbon atoms, (d) an alkyl carboxyl radical having 2 to 18, preferably 2 to 10, carbon atoms, (e) a nitrile group, (f) a halogen atom or (g) an alkoxy carbonyl radical having 2 to 12, preferably 2 to 9, carbon atoms and $R^4$ is a hydrogen atom or a methyl radical.

Particularly suitable vinyl monomers are (a) olefins, for example ethylene, propylene and isobutylene, (b) styrene, N-vinylpyrrolidone and vinylpyridine, (c) vinyl ethers, for example vinyl methyl ether, vinyl ethyl ether and vinyl n-butyl ether, (d) vinyl esters of aliphatic carboxylic acids, for example vinyl acetate, vinyl propionate, vinyl butyrate, vinyl pivalate, vinyl laurate and vinyl decanoates, (e) acrylonitrile and methacrylonitrile, (f) vinyl halides, for example vinyl chloride and propenyl chloride, and (g) acrylic acid esters or methacrylic acid esters of monohydric alkanols, for example methyl acrylate, ethyl acrylate, butyl acrylate, 2-ethylhexyl acrylate, methyl methacrylate, ethyl methacrylate, butyl methacrylate, hexyl methacrylate, octyl methacrylate and 2-ethylhexyl methacrylate. Vinyl monomers which are likewise suitable are maleic acid diesters and fumaric acid diesters, in particular of monohydric alkanols having 2 to 10, preferably 3 to 8, carbon atoms, for example dibutyl maleate, dihexyl maleate, dioctyl maleate, dibutyl fumarate, dihexyl fumarate and dioctyl fumarate.

The use of a vinyl ester as the vinyl monomer, if appropriate together with another of the vinyl monomers mentioned, preferably an olefin or a (meth)acrylic acid ester, is particularly advantageous. The amount of vinyl monomer or vinyl monomer mixture employed for copolymerization with a carboxylic acid amide is 95 to 75% by weight, preferably 90 to 85% by weight, of the total amount of monomer. If a vinyl ester is employed with another vinyl monomer, the content of vinyl ester is usually at least 50% by weight, preferably 75 to 95% by weight, of the total amount of vinyl monomers.

Carboxylic acid amides of the formula (I) which are used are, for example, acrylamide, methacrylamide and crotonamide, as well as N-methylolacrylamide, N-methylolmethacrylamide and N-methylolcrotonamide. The amount of carboxylic acid amide is 5 to 20% by weight, preferably 7 to 14% by weight, of the total amount of monomer.

If appropriate, a copolymerizable unsaturated carboxylic acid, in particular an aliphatic monocarboxylic acid having 3 or 4 carbon atoms or an aliphatic dicarboxylic acid having 4 or 5 carbon atoms, is also employed as a further monomer.

Examples of suitable unsaturated carboxylic acids are acrylic acid, methacrylic acid, crotonic acid, itaconic acid, maleic acid and fumaric acid. The amount of carboxylic acid is not more than 5% by weight, preferably 0.1 to 3.0% by weight, of the total amount of monomer.

The copolymers used according to the invention can be prepared by a process analogous to that of EP-A-0 014 450. For the abovementioned reasons, however, the use of poly(vinyl alcohol), for example as a protective colloid, is not suitable, and the copolymers used according to the invention are therefore free from poly(vinyl alcohol).

The polymer dispersions prepared in general have a solids content of 40 to 70% by weight, preferably 45 to 60% by weight. The viscosity of the dispersions is usually in the range from 1 to 20 Pa.s, preferably from 1.5 to 7.0 Pa.s (measured by the Epprecht method).

They are suitable as color transfer inhibitors in liquid detergents, and furthermore are used as the starting material for the preparation of redispersible powders. The powders are obtained by drying, for example roller drying, freeze drying and, preferably, spray drying, of the polymer dispersion. The dispersible powders based on the aqueous dispersions are employed according to the invention as color transfer inhibitors in solid detergents, it being possible for the aggregate particle size in general initially to be between 800 and 1000 μm. Examples which may be mentioned of copolymer dispersions according to the invention are dispersions based on vinyl acetate, ethylene and an acrylic acid derivative, such as acrylamide.

The detergents which contain the color transfer inhibitors according to the invention can be either industrial detergents or domestic detergents. These include, in particular, pulverulent and liquid heavy-duty detergents, pulverulent and liquid light-duty detergents, machine dishwashing agent boosters, such as stain-removing salts and pastes, and laundry aftertreatment agents (fabric formers and softening rinses). The most essential components of the detergents are the wash-active surfactants, which are chiefly (a) anionic, non ionic and/or zwitterionic wash-active surfactants.

The anionic wash-active surfactants are chiefly sulfonates, such as alkylarylsulfonates, for example dodecylbenzenesulfonate, alkylsulfonates and alkenylsulfonates, and sulfates, for example alkyl sulfates, sulfates of ethoxylated amides, esters of α-sulfo-fatty acids or else soaps of naturally occurring, optionally modified or synthetic fatty acids, the anionic surfactants advantageously being in salt form, for example as an alkali metal salt (sodium or potassium), as an ammonium salt or as the salt of organic bases, in particular monoethanolamine, diethanolamine or triethanolamine salts. The anionic surfactants furthermore include sulfosuccinates, alkyl ether-sulfates, alkyl ether-carboxylates and fatty acid condensation products, such as are usually used in washing and cleaning formulations.

Possible nonionic wash-active surfactants are chiefly polyethylene glycol ethers of higher alcohols or alkyl phenols, polyethylene glycol esters of fatty acids and polyoxyethylation products of fatty acid amides. The fatty radicals or alkyl and alkenyl radicals in the abovementioned surfactants or alcohols or fatty acids contain, for example, 8–20 carbon atoms; aryl is chiefly phenyl; the polyethylene glycol chains can contain, for example, 3–80 ethyleneoxy groups, and optionally comprise propyleneoxy units. Typical nonionic surfactants are alkyl polyethoxylates, alkyl polyglycosides, glucamides, alkylamine N-oxides, alkylphosphine oxides and condensation products of fatty alcohols with ethylene oxide and propylene oxide.

Preferred anionic surfactants (a) are the alkylbenzenesulfonates, the alkanesulfonates, the alkylsulfonates and the soaps, and preferred nonionic surfactants (a) are the alkyl polyglycol ethers.

Examples of zwitterionic surfactants are derivatives of aliphatic quaternary ammonium, phosphonium and sulfonium compounds, such as are known from U.S. Pat. No. 3 925 262 and U.S. Pat. No. 3 929 678.

Depending on the field of use and intended use of the detergents, these can comprise, for example, only the components (a), as described above (for example for industrial purposes), or also contain one or more other additives (for example also for industrial purposes or, in particular, for domestic detergents), it being possible for the following additives essentially to be mentioned:

(b) sequestering agents (c) enzymes (d) bleaching agents—if appropriate together with customary bleaching additives, in particular ($d_1$) activators and/or ($d_2$) stabilizers (e) washing alkalis (f) anti-redeposition agents Sequestering agents (b) which may be mentioned are the usual complexing substances, for example amino polyacetates (in particular nitrilotriacetate or ethylenediaminetetraacetate), aminopolymethylene phosphates, sodium triphosphate, sodium tripolyphosphates, sodium aluminum silicates, sodium silicate, magnesium silicate, zeolite A, polyacrylates (for example ammonium polyacrylates), poly-α-hydroxyacrylates and salts of hydroxycarboxylic acids (for example sodium citrate, sodium tartrate and sodium gluconate).

Enzymes (c) which may be mentioned are, for example, the customary proteases, lipases, cellulases and amylases.

Possible bleaching agents (d) are the customary peroxy compounds, for example perborates, percarbonates, perphosphates or peroxides, in particular as alkali metal salts or else, especially in liquid formulations, hydrogen peroxide. Possible stabilizers for the per compounds are, for example, the abovementioned sequestering agents, and the customary carboxylic acids or amido derivatives may be mentioned as activators which are present if appropriate.

The customary bases can be used as washing alkalis (e) for example ammonium or alkali metal silicates, phosphates, carbonates, borates or hydroxides; the particular alkaline per compounds above can also act as washing alkalis, where appropriate.

Possible anti-redeposition agents (f) which are optionally present are the customary substances, in particular benzotriazoles, ethylenethiourea or cellulose ethers (for example carboxymethylcellulose).

If appropriate, the detergents can also comprise other additives, for example defoamers (or foam stabilizers), fragrances, disinfectants, buffer salts, compounds which liberate active chlorine, anti-corrosion agents, solvents, solubilizing agents, finishing substances or carriers, preservatives and other electrolytes (for example sodium sulfate).

The proportional compositions of the detergents can vary within wide limits, depending on the manufacturer and intended use.

The copolymers used according to the invention can be added individually to the wash liquors or, if desired, incorporated into the detergents.

Washing is carried out chiefly under weakly acidic to significantly basic conditions, advantageously at pH values in the range of 6–12, preferably 7–10. The additives according to the invention are advantageously employed in concentrations of 0.05 to 10 g/l, preferably 0.5 to 4 g/l of aqueous wash liquor. The content of these compounds in the detergent formulation is advantageously in the range from 0.2 to 10% by weight, preferably 1–6% by weight.

Washing can be carried out under customary conditions and as envisaged in the particular washing programs of commercially available washing machines, expediently in an overall washing process, in which all the constituents are present in the liquor and are preferably added. The washing temperature can likewise vary within the customary ranges, for example in the range of 15°–95° C., the temperatures in the range of 30°–60° C. which are customary for a colored wash and nowadays generally, being preferred here.

Any desired materials can be washed, i.e. such as are envisaged for the particular washing operations in industry and the home, for example loose fibers, filaments, threads, bobbins, woven fabric, knitted fabric, nonwovens, open webs, tubular goods, velvet, felt, tufted goods, carpets, structured, porous material-like plastics materials (such as are used in the home and for clothing) and in particular semi-finished and finished goods. The substrates can be made of any desired, customary materials, for example naturally occurring or regenerated cellulose (for example cotton, linen, hemp, viscose), naturally occurring polyamides (for example wool, silk) or synthetic materials (for example polyamides, polyesters, polyacrylonitriles, polypropylene or polyurethanes) and mixtures thereof. The cellulose-containing substrates, and above all colored laundry which contains dyed cellulose substrates, are to be singled out among these in particular.

The detergent additives according to the invention are readily compatible with the customary detergents, for example as listed above, and practically do not impair their washing action, and may even assist it. They prevent reabsorption of bled dyestuffs and dyestuff degradation products onto the washed material, in particular that washed at the same time, surprisingly well, and analogously to the other components of the wash liquor, can be rinsed out of the washed material. They do not attack the laundry. Compared with the known polymeric color transfer inhibitors, they are distinguished by a mostly superior efficiency, and furthermore have a good biodegradability. Depending on the consistency of the detergent formulation—whether liquid or pulverulent—the color inhibition additives according to the invention can be metered in during make-up either as an aqueous dispersion or as a redispersible dispersion powder.

EXAMPLES

Color transfer inhibitors employed:

Example 1

55% strength by weight aqueous polymer dispersion of a copolymer of 80% by weight of vinyl acetate, 10% by weight of ethylene and 10% by weight of acrylamide

Example 2

Redispersible dispersion powder prepared by spray drying the aqueous polymer dispersion according to Example 1.

Washing experiments in a Launder-O-meter:

The washing experiments were carried out in a Launder-O-meter at 40° C. The washing time was 40 minutes. The detergent concentration was 4 g/l of WMP test detergent (W äschereiforschung Krefeld). The water hardness was 16° dH [German hardness]. 1.25 g of cotton fabric dyed with a brown textile dyestuff (®Diamin Braun-BK; Hoechst AG, DE) were washed in 400 ml of wash liquor together with white cotton fabric.

In each case 1.3% by weight, based on the test detergent, of the copolymer used according to the invention, based on the solids content, was added to the wash liquor and the whiteness of the white fabric was determined by reflectance measurement after the washing process. Polyvinylpyrrolidone (PVP) having a weight-average molecular weight $M_w$ of about 10,000 was employed as the comparison substance.

| Compound | Reflectance of the white fabric after washing |
|---|---|
| Example 1 | 59.8% |
| Example 2 | 58.9% |
| Comparison | |
| PVP | 56.1% |
| No additive | 55.2% |

The result illustrates that the compounds claimed according to the invention significantly suppress color transfer of the brown dyestuff from the dyed fabric to the white fabric.

At comparable use concentrations, the compounds according to the invention are superior in activity to the previous standard polyvinylpyrrolidone (PVP).

What is claimed is:

1. A method for preventing reabsorption, by a textile, of detached dyestuffs or dyestuff degradation products which are detached from a dyed material or degraded from dyes in a dyed material in an aqueous wash liquor for said textile containing a wash-active component selected from the group consisting of an anionic surfactant, a nonionic surfacting, a zwitterionic surfactant, and mixtures thereof, said method comprising the step of:

adding to the wash liquor a copolymer comprising 75–95% by weight of the total amount of monomer of at least one vinyl monomer which is free from carboxyl and amide groups, 5–20% by weight of at least one carboxylic acid amide of the formula (I)

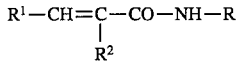

in which

R is a hydrogen atom or a methylol radical, $R^1$ is a hydrogen atom or a $C_1$–$C_3$-alkyl radical and $R^2$ is a hydrogen atom or a methyl radical, and optionally not more than 5% by weight of a copolymerizable unsaturated carboxylic acid.

2. The method as claimed in claim 1 wherein the copolymer comprises 85–90% by weight of the total amount of monomer of at least one vinyl monomer which is free from carboxyl and amide groups, 7–14% by weight of at least one carboxylic acid amide of the formula (I) and 0.1 to 3.0% by weight of a copolymerizable, unsaturated carboxylic acid.

3. The method as claimed in claim 1 wherein at least one vinyl monomer is selected from the group consisting of olefins, vinyl ethers, vinyl esters of aliphatic carboxylic acids having 2 to 18 carbon atoms, (meth)acrylic acid esters of $C_2$–$C_9$-alkanols or a mixture thereof.

4. The method as claimed in claim 1 wherein the copolymer comprises at least two vinyl monomers which are free from carboxyl and amide groups and wherein at least 50% by weight of the total amount of vinyl monomers comprises vinyl ester.

5. The method as claimed in claim 4 wherein the content of the vinyl ester is 75 to 95% by weight of the vinyl monomers.

6. The method as claimed in claim 1 wherein the copolymerizable unsaturated carboxylic acid comprises an aliphatic monocarboxylic acid having 3 or 4 carbon atoms or an aliphatic dicarboxylic acid having 4 or 5 carbon atoms.

7. The method as claimed in claim 1 wherein the copolymer is employed in the form of an aqueous polymer dispersion.

8. The method as claimed in claim 7, wherein the aqueous polymer dispersion has a solids content of 40 to 70% by weight.

9. The method as claimed in claim 8, wherein the aqueous polymer dispersion has a viscosity in the range from 1 to 20 Pa.s (measured by the Epprecht method).

10. The method as claimed in claim 1 wherein the copolymer is employed as a dispersion powder.

11. The method as claimed in claim 1, wherein said copolymer is an additive to an industrial detergent or domestic detergent.

12. A detergent composition comprising a wash-active component selected from the group consisting of an anionic surfactant, a nonionic surfactant, a zwitterionic surfactant, and mixtures thereof, and a copolymer of vinyl acetate/ethylene/acrylamide, wherein said vinyl acetate and ethylene together are present in an amount of 75–95% by weight of the copolymer, the ratio of said vinyl acetate to said ethylene is from 1:1 to 20:1, and said acrylamide is present in the amount of 5–20% by weight of the copolymer.

13. A detergent as claimed in claim 12, wherein the vinyl acetate is present in an amount of about 80% by weight, the ethylene is present in an amount of about 10% by weight, and the acrylamide is present in an amount of about 10% by weight, each based upon the copolymer.

14. A detergent as claimed in claim 11, additionally comprising at least one compound selected from the group consisting of a sequestering agent, optical brightener, enzyme, bleaching agent and optionally stabilizer and activator, and washing alkali.

* * * * *